US005128682A

United States Patent [19]

Kruger

[11] Patent Number: 5,128,682

[45] Date of Patent: Jul. 7, 1992

[54] DIRECTIONAL TRANSMIT/RECEIVE SYSTEM FOR ELECTROMAGNETIC RADIATION WITH REDUCED SWITCHING

[75] Inventor: Bradford E. Kruger, Woodland Hills, Calif.

[73] Assignee: ITT Corporation, New York, N.Y.

[21] Appl. No.: 690,699

[22] Filed: Apr. 24, 1991

[51] Int. Cl.[5] ..... H01Q 3/02

[52] U.S. Cl. ..... 342/153; 342/374

[58] Field of Search ..... 342/149, 153, 374, 368, 342/372, 371

[56] References Cited

U.S. PATENT DOCUMENTS

| | | | |
|---|---|---|---|
| 4,983,977 | 1/1991 | Hrycack | 342/153 |
| 5,017,927 | 5/1991 | Agrawal et al. | 342/371 |
| 5,041,835 | 8/1991 | Matsumoto | 342/374 |

OTHER PUBLICATIONS

Merrill Skolnik, *Radar Handbook* (2d Ed.), Chapter 18 by Dean Howard, "Tracking Radar", pp. 18.1-18.22, McGraw-Hill Publishing Co., 1990.

Fisher, "GaAsIC Applications in Electronic Warfare, Radar and Communications Systems", *Microwave Journal*, May 1988, pp. 275-292.

*Primary Examiner*—Mark Hellner

*Attorney, Agent, or Firm*—Richard S. Koppel

[57] ABSTRACT

A transmit/receive system for electromagnetic radiation, particularly radar, employs an array of active transmit/receive (T/R) modules. Only a portion of the modules are actuated to transmit or receive signals at any given time. Input transmit power is supplied to all modules, but only the selected portion of modules actually amplify their inputs. The power loss is thus kept small because the amplified signal power far outweighs the lost input power. This approach makes possible a monopulse signal routing scheme that minimizes the number of switches used and their accompanying reliability problems. Transmit and receive signals are routed through sum-and-difference circuits and respective sectors of the T/R modules such that during RECEIVE no switches are necessary to acquire a monopulse sum (Σ) signal, and only a single switch is required to acquire a monopulse difference (Δ) signal. Similarly, no switching of module inputs is required during TRANSMIT.

30 Claims, 5 Drawing Sheets

DIRECTIONAL TRANSMIT/RECEIVE SYSTEM FOR ELECTROMAGNETIC RADIATION WITH REDUCED SWITCHING

BACKGROUND OF THE INVENTION

1. Field of the Invention

This invention relates to electromagnetic beam transmission/reception systems, and more particularly to radar systems employing active transmit/receive (T/R) modules for directional transmission and reception applications such as monopulse tracking.

2. Description of the Prior Art

An ability to detect slight angular variations from a reference direction is required for an effective radar tracking system. A typical tracking radar has a narrow beam in at least one dimension to receive echoes from a target, and thereby track the target in that dimension. An early technique for radar tracking involved sensing the target location with respect to the radar antenna axis by rapidly switching the beam from one side of the axis to the other. By observing an oscilloscope that displayed the video return from the two beam positions side-by-side, the target's angular position relative to the axis could be determined. With the target on-axis, the two pulses were of equal magnitude; when the target moved off axis, the two pulses became unequal. When a pulse inequality was observed, the operator could reposition the antenna to regain a balance and thus track the target. This technique is called sequential lobing.

The above technique was later extended to the continuous rotation of a pencil beam about the target. Error signals proportional to the angular tracking error, with a phase or polarity indicating the direction of the error, were generated and used to actuate a servosystem that drove the antenna in the proper direction to reduce the error to zero. This technique is called conical scan.

The susceptibility of these techniques to echo amplitude fluctuations led to the development of a tracking radar that provided all of the necessary lobes for angle-error sensing simultaneously. By comparing the output from the lobes simultaneously on a single pulse, the effect of echo amplitude fluctuations over time was eliminated. This technique became known as monopulse, referring to its ability to obtain complete angle error information with a single pulse. While developed in connection with tracking radar, the monopulse approach is also used in other systems such as homing devices, direction finders and some search radars. The sequential lobing, conical scan and monopulse techniques are well known, and are described for example in *Radar Handbook* (2d Ed.) by Merrill Skolnik, Chapter 18 by Dean Howard "Tracking Radar", pp. 18.1–18.22, McGraw-Hill Publishing Co., 1990.

FIG. 1 is a block diagram of a conventional azimuth monopulse tracking radar system. A pair of "feed horns" or radar transmission/reception elements 2 are shown, although in a practical system a more sophisticated antenna would be employed. With the system in a RECEIVE mode, the radar signals received by the two elements are fed to a sum-and-difference processor 4 that compares the outputs from the two elements to sense any imbalance in the azimuth direction of the received radar signals with respect to their center axis. Sum-and-difference processor 4 is typically implemented with a hybrid T or magic T waveguide device that produces a sum ($\Sigma$) output representing the in-phase portion of the two received signals, and a difference ($\Delta$) output representing any phase difference between the two received signals. If the received echo signals are identical, the $\Sigma$ output is unity and the $\Delta$ output is zero; the $\Delta$ output increases rapidly, and the $\Sigma$ output decreases slowly, as the two received signals differ more and more. The signals differ when the target is not exactly in line with a perpendicular to the two feed horns 2, i.e., when the target is off-boresight with respect to the feed horns in azimuth.

The $\Sigma$ and $\Delta$ signals are converted to intermediate frequency (IF) by mixers 6, 8, using a common oscillator 10 to maintain relative phase at IF. The IF $\Sigma$ signal is amplified in IF amplifier 12 and detected by amplitude detector 14 to provide a video input to range tracker 16 via a video amplifier 18. The range tracker 16 determines the time of arrival of the desired target echo, and provides gate pulses which turn on portions of the radar receiver only during the brief period when the desired target echo is expected.

The $\Delta$ signal is amplified by IF amplifier 20, whose output is applied along with the output of $\Sigma$ IF amplifier 12 to a phase detector 22. The phase detector produces an output azimuth angle error signal in the form $\Delta\sin\Theta/\Sigma$, where $\Theta$ is the phase angle between the $\Sigma$ and $\Delta$ signals. With the radar properly adjusted, $\Theta$ is normally either 0° or 180°. The function of the phase detector is to provide a + or − polarity, giving a directional sense to the azimuth error output.

In a pulsed tracking radar the azimuth error output is bipolar video, that is, a video pulse with an amplitude proportional to the angular error and a polarity that corresponds to the direction of the error. This video signal is typically processed by a boxcar circuit (not shown) which charges a capacitor to the peak video pulse voltage and holds the charge until the next pulse, at which time the capacitor is discharged and recharged to the new pulse level. With moderate low-pass filtering, a DC error voltage output is produced that is used by the system's servo-amplifiers to correct the antenna positions and track the target.

The gated video signal from range tracker 16 is used to generate a DC voltage proportional to the magnitude of the $\Sigma$ signal for an automatic gain control (AGC) circuit 24 in both IF amplifier channels. The AGC maintains a constant angle tracking sensitivity, even though the target echo signal varies over a very large dynamic range, by controlling gain or dividing by $\Sigma$. AGC is necessary to keep the gain of the angle tracking loops constant for stable automatic angle tracking.

During the TRANSMIT mode, an exciter 26 generates the waveform to be radiated. This signal is processed through power amplifier 28, and routed through a duplexer 30 to the radiating elements 2 via the sum channel. The duplexer 30 acts as a passive directional rapid switch to protect the receiver from damage when the high power transmitter is on; during RECEIVE it directs the weak received signal through the receiver section rather than to the transmitter.

While only two radiating/receiving elements 2 are shown in FIG. 1 for simplicity, complex systems can have a much larger number of elements. A more complex system is illustrated in FIG. 2, in which a much larger number of radiating/reception elements are shown divided into numerous sets 32 of plural elements each; the total number of elements can be in the hundreds or more. Although illustrated as a linear array for simplicity, the elements could be arranged in a cylindrical array or any other desired geometric format, e.g., an arc. The sets of elements are organized into sectors, with each set within a given sector transmitting or receiving at a given time. For purposes of illustration, 16 sets 32 of elements are shown, arranged in 13 sectors of 4 sets each. If the array shown were cylindrical, 16 sectors would be selectable. Three successive sectors are identified by reference numerals 34, 36 and 38.

This type of array is scanned by switching in and switching out connections between the transmitter/-receiver and different sectors. The selection of sectors can jump from one part of the array to another, or can progress from each sector to the next adjacent one, e.g., 34, 36 to 38. In the latter case, a set of elements at one side of the sector is switched off and the next set of elements immediately on the other side of the sector is switched on each time the selected sector is advanced.

A centralized transmitter 40 and receiver 42 are connected via a duplexer 43 and feed network 44 to a set of switches 46*a*, 46*b*, 46*c*, and 46*d*. Each switch is an M pole device, where M is the number of element sets 32, and can be connected to any of the different sets. To make a connection between a particular desired sector and the signal feed network 44, each switch is set to a different one of the 4 sets of elements 32 within the desired sector. For example, switch connections to sectors 34, 36 and 38 are indicated by solid, dashed and dotted lines, respectively. If more sets of radiating elements 32 are employed, there is a corresponding increase in the number of terminals within each switch. The total number of switches will equal the number of element sets within each sector. To scan from one sector to the next, the setting of each switch is advanced by one terminal per sector. With the 16 sets of elements illustrated, a full 360° scan around a cylindrical array requires that the switches be advanced through 16 successive sectors, each 22½ apart.

The switches are generally electromechanical or PIN diodes, which are both subject to failure. The failure rate per radar system increases, and the system reliability drops correspondingly, as the number of switches is increased.

In contrast to the centralized feed system of FIG. 2, active transmit/receive (T/R) modules have been developed recently that can generate RF power directly at the antenna elements, set relative phase relationships between the elements, and amplify a received signal. Locating the modules at each antenna element in the antenna array simplifies the problem of scanning non-linear/non-planar array configurations without a central RF power source.

Active T/R modules are described, for example, in Fisher, "GaAsIC Application's in Electronic Warfare, Radar and Communication Systems", *Microwave Journal*, May, 1988, pp. 275–292. They have low RF losses, a low vulnerability to interference, and distributed rather than centralized power generation. However, simply adding T/R modules to the system of FIG. 2 would involve providing a module at each of the antenna elements while still having to connect all of the modules to a central signal processing location, and switching between the sets of modules. Even with the illustrative total of 16 sets and 4 sets per sector, this would still require the use of 4 different 16-way switches with their attendant reliability problems.

SUMMARY OF THE INVENTION

The present invention seeks to provide a new transmit-receive system for electromagnetic radiation such as radar that significantly reduces the amount of switching necessary during scanning among an array of antenna elements. In particular, it seeks to make possible monopulse operation with only a single multi-pole switch during RECEIVE, and without any switching elements at all during TRANSMIT.

These goals are realized by connecting a plurality of selectively actuable active T/R modules to transmit signals to, and receive signals from, respective antenna elements, with the modules amplifying their transmitted and received signals only when they are actuated. Transmission signals are supplied to all of the modules simultaneously, but only one sector of modules is actuated at any given time. The input drive power supplied to the non-actuated module is lost, but these are low level signals whose power is very much less than that of the amplified signals produced at the outputs of the actuated modules.

The invention can be applied to a monopulse system having M sets of antenna elements, of which N sets in a contiguous sector are actuated at any one time. M sum-and-difference circuits are provided, if operation is to be provided over the complete array of elements, to produce Σ and Δ signals during RECEIVE. A signal routing network connects the sum-and-difference circuits with the selected sector of modules during both RECEIVE and TRANSMIT. Only one sector of T/R modules is actuated at any given time, leaving the modules outside of that sector unactuated. Thus, a radar beam will be transmitted only from the actuated sector during TRANSMIT, and an incoming beam will produce signals for further processing only from the actuated sector during RECEIVE.

The signal routing network is established such that only one multi-pole switch is required, and that switch is isolated to the Δ channel and used only during RECEIVE. The switch selects among the M Δ signals from the sum-and-difference circuits during RECEIVE so that only the Δ signal from the selected sector is obtained for use in the azimuth error calculation. A signal combiner/divider in the Σ channel combines the Σ signals from each of the sum-and-difference circuits into a single composite signal during RECEIVE, and divides an input signal among each of the sum-and-difference circuits during TRANSMIT.

The signal routing network includes two arrays of signal combiner-dividers. During RECEIVE, the combiner-dividers in the first array combine input signals from respective sets of T/R modules into output signals that are delivered to respective combiner-dividers within the second array, where the combined signals are divided into N output signals; the latter output signals are distributed among the sum-and-difference circuits so that each detector receives signals from a respective sector of T/R modules. During TRANSMIT, a transmit signal is distributed along the Σ channel among each of the sum-and-difference circuits, each of which divides its input signal among N respective combiner/dividers in the second array, which in turn combine divided signals from N sum-and-difference circuits each into an input signal for respective combiner-dividers in the first array. There the signals are divided into output signals for delivery to respective sets of T/R modules.

In addition to requiring only a single multi-pole switch, which is used only during RECEIVE, the system operates with low power on-off control within the individual T/R modules to provide actuation or non-selection. These and other features and advantages of the invention will be apparent to those skilled in the art from the following detailed description, taken together with the accompanying drawings, in which:

DETAILED DESCRIPTION OF PREFERRED EMBODIMENT

Figure 3:
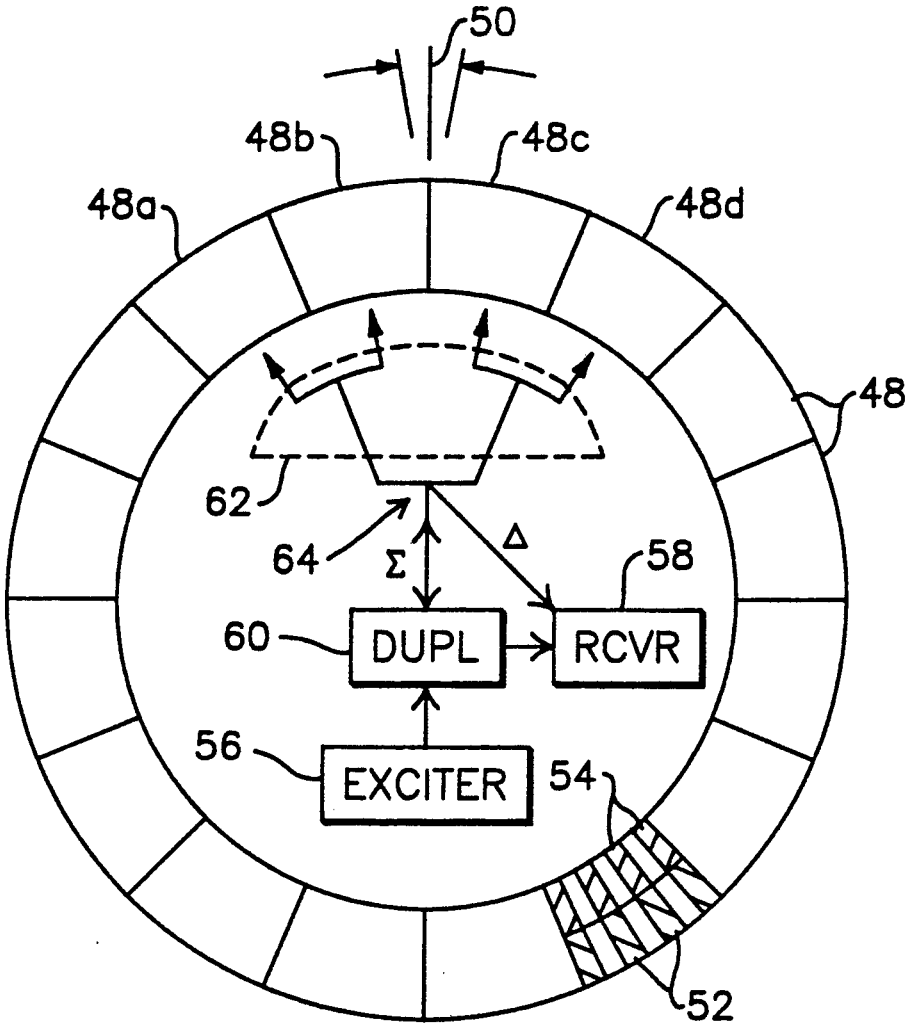
FIG. 3 is a block diagram illustrating the selective T/R module actuation of the present invention.

FIG. 3 illustrates the approach taken by the present invention to integrate active T/R modules into an effective radar transmit/receive system, and to minimize the amount of switching required for a monopulse system. Although described in connection with radar, the invention is also applicable to other electromagnetic systems which require scanning monopulse tracking, such as "identification friend or foe" (IFF). Unitary antenna elements are described herein which serve both transmission and reception purposes, but these functions could be divided into separate transmission and reception elements within the scope of the invention.

A cylindrical array is shown, organized into M antenna element-T/R module sets 48. The M sets 48 are in turn organized into sectors of N sets each. In the example given in FIG. 3, M=16 and N=4, but these numbers are only for exemplary purposes. For a cylindrical array, N must only be less than M/2, with M being boundless.

One particular sector is illustrated, formed from four sets 48*a*, 48*b*, 48*c* and 48*d*. Thus, the N-set sector encompasses an arc of 90°. The sector's center axis 50 is aligned between interior sets 48*b* and 48*c*. The sector and its axis may be scanned over angle of ±11.25° from center axis 50 by means of phase shifters within each set. The next sector in the counterclockwise direction has a center axis between sets 48*a* and 48*b*, while the next sector in the clockwise direction has a center axis between sets 48*c* and 48*d*, etc.

Each of the sets 48 consists of a spatial array of antenna elements 52 for radiating and receiving radar signals. Each antenna element is coupled to a respective T/R module 54, which when actuated amplifies either a transmit signal delivered to its input, or an echo signal returned from the antenna element. The T/R modules of each sector are coupled with an exciter 56 and receiver section 58 via a specially designed routing network 62 that significantly reduces the switching requirements of prior systems, and a sum-and-difference processor (differential phase detector) 64. The routing network 62 routes transmission signals from the exciter 56 to each of the T/R modules, while in the other direction the sum-and-difference processor 64 delivers Σ and Δ signals for processing by the receiver 58. A transmission beam will be aligned with the selected axis of the actuated sector (as adjusted by the phase settings of the T/R modules), whereas a returned echo signal may be either on- or off-axis.

During TRANSMIT, a transmission signal is delivered over the Σ channel and divided equally among the sets 48*a*–48*d*. All of the transmission signals delivered to the sets 48*a*–48*d* are amplified by their included T/R modules 54 and radiated by their included antenna elements 52, producing an output beam that is centered on the sector's center axis 50 (or off-center up to ±11¼° if the phase relationship of the T/R modules has been so selected). With a cylindrical antenna array of 16 sectors, the system is limited to a 22¼° scan (1/16 of 360°) for any individual sector.

Figure 1:
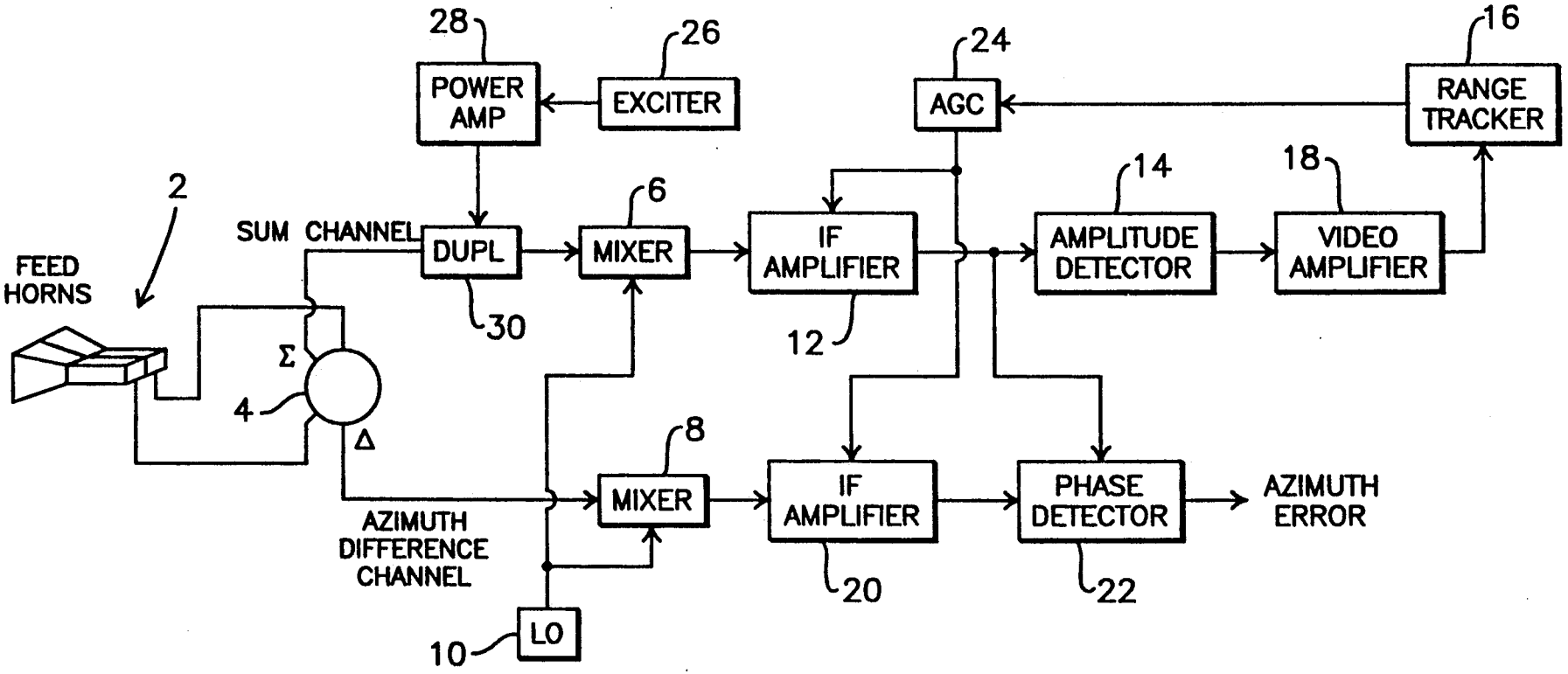
Fig. 1 (Prior Art)
FIG. 1 is a block diagram of a conventional azimuth monopulse tracking radar system, described above.
Figure 2:
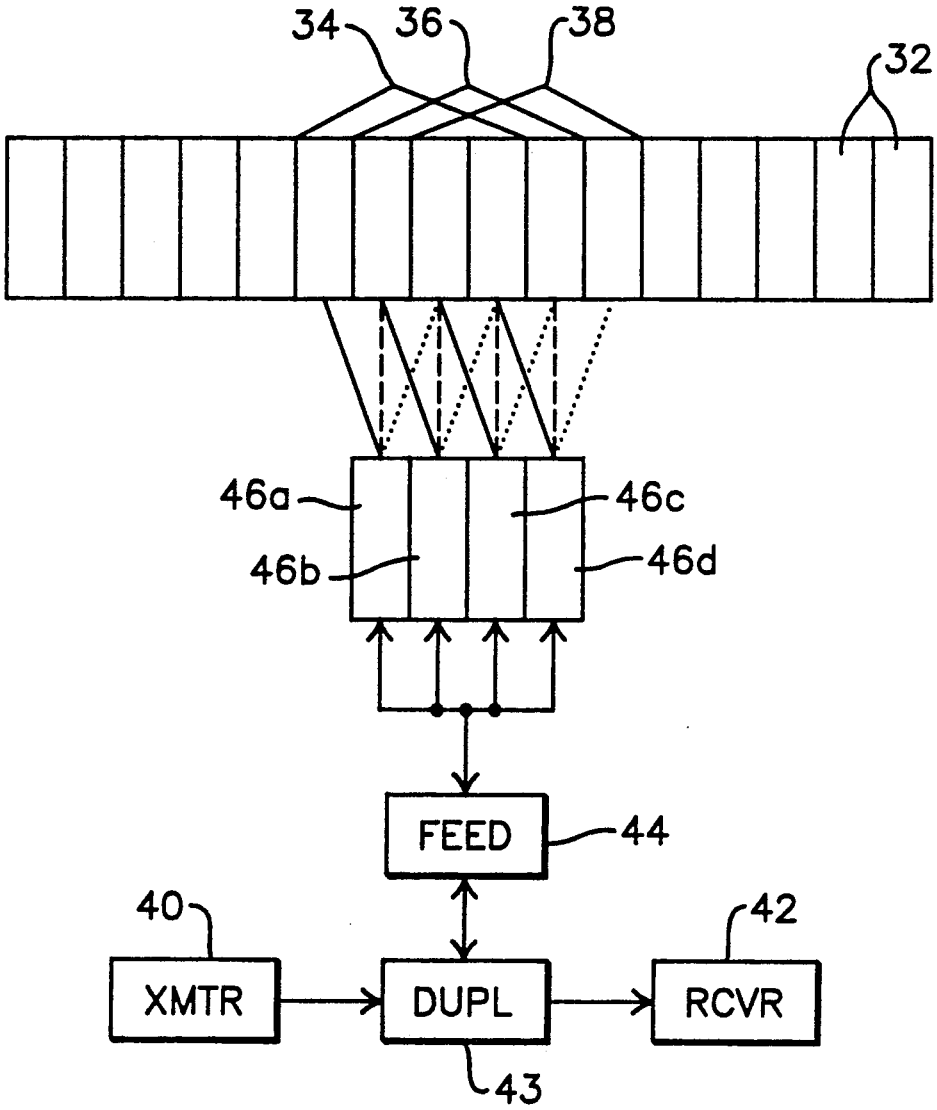
FIG. 2 is a block diagram illustrating the multiple switches required for a conventional scanning azimuth system, described above.

During the RECEIVE mode with an echo signal expected in the vicinity of center axis 50, the T/R modules within the four sets 48*a*–48*d* are actuated, while the other twelve T/R module sets are unactuated. The phase settings of the actuated T/R modules are sector adjusted so that the sector axis is within the 22¼° angle described above. Signals from each of the actuated sets are delivered via the routing network 62, described in detail below, to the sum-and-difference processor 64 that is assigned to the actuated sector. The sum-and-difference processor 64 combines the summed signals from sets 48*a* and 48*b* on one side of the sector's selected axis, and the summed signals from the other selected sets 48*c* and 48*d* on the opposite side of the sector's selected axis. The sum-and-difference processor outputs a Σ signal representing the sum of the in-phase portion of the two composite signals, and a Δ signal representing their out-of-phase component. These signals can then be processed in a standard monopulse processor such as that shown in FIG. 1 to determine the azimuth angle error with respect to the selected axis.

Figure 4:
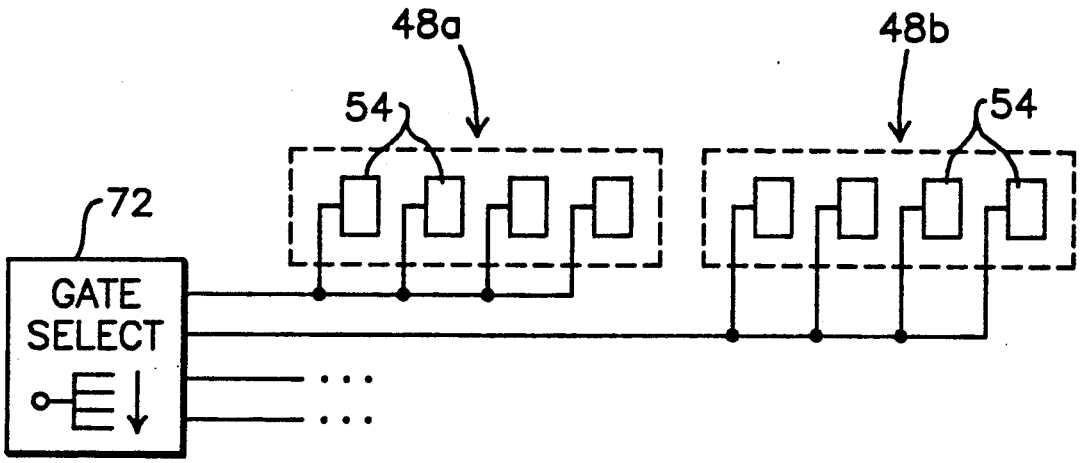
FIG. 4 is a block diagram of the T/R module actuation arrangement employed in connection with the system of FIG. 3.

As mentioned above, the T/R modules in only one selected sector are actuated at any given time, with the remaining T/R modules unactuated until their respective sectors are selected. Each of the T/R modules within a particular set are gated "on" when that set is within the selected sector. A simplified circuit to accomplish this is illustrated in FIG. 4. The various T/R modules 54 are grouped into their respective sets, with a control circuit 72 providing a common actuation control for the modules within each set. Control circuit 72 delivers actuation signals for all of the sets within a selected sector simultaneously; with N=4 sets per sector, four actuation signals are provided at any given time. As successive sectors are selected, the gate select 72 shifts among the sets of modules to actuate the sets of each selected sector in turn.

Figure 5:
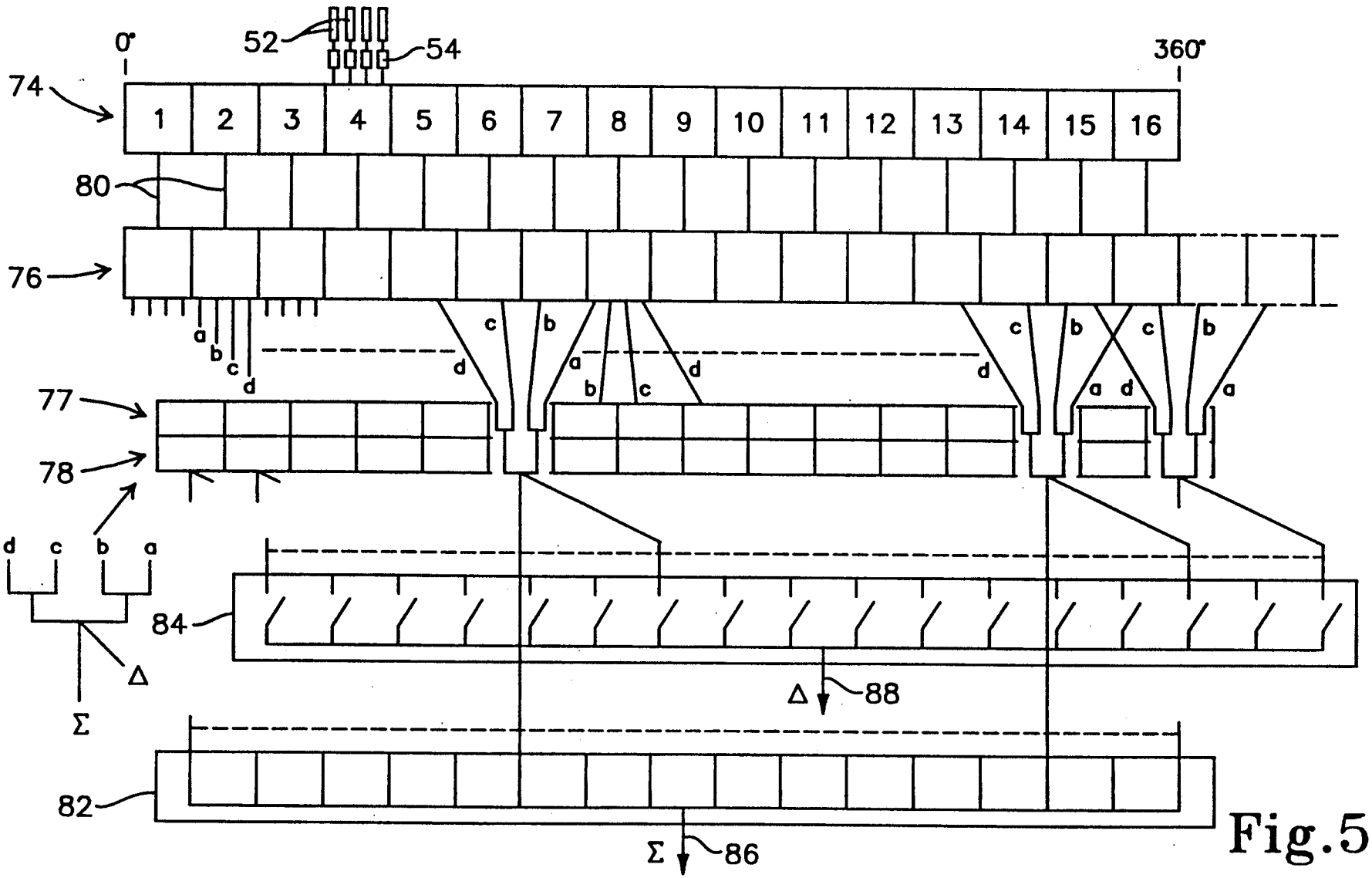
FIG. 5 is a diagram showing details of the preferred signal routing network employed with the system of FIG. 3.

Details of the complete routing network are shown in FIG. 5. It includes first, second and third arrays 74,76 and 77 of combiner-divider circuits, as well as an array of sum-and-difference processors (differential phase detectors) 78. One combiner-divider circuit is provided in each array 74,76,77 for each set of T/R modules 54 and antenna elements 52. The combiner-dividers within the first and second arrays 74 and 76 are connected by respective interconnect lines 80. The Σ outputs from each of the sum-and-difference processors 78 are connected to another combiner-divider circuit 82, while the Δ outputs are each connected to respective poles of a single M-pole switch 84.

During TRANSMIT, a signal from the exciter is delivered over the Σ channel 86 and is equally divided by combiner-divider 82 among each of M=16 sum-and-difference processors 78. (M is set equal to 16 for illustrative purposes only. M could equal any desired even number equal to or greater than 6.) The transmission signals from sum-and-difference processors 78 are then divided by combiner-divider circuits 77 and distributed among the second array of combiner-dividers 76. Since each combiner-divider in array 76 receives a total of N (4 in the illustrated example) signals, one from each of four sum-and-difference processors 78, the combiner-dividers 76 will output transmission signals over lines 80 that are, neglecting losses, equal in power to the signals initially applied to the sum-and-difference processors 78.

The combiner-dividers in array 74 divide the received transmission signals from lines 80 among their respective T/R modules 54, shown as four modules for illustrative purposes only. Since only one sector (N sets of modules) is actuated at any particular time, the transmission signals from only four out of the sixteen sets will be amplified, with the signals applied to the remaining T/R modules not contributing to the final transmitted radar beam. Thus, $\frac{3}{4}$ (N/M) of the power in the original transmission signal will be lost. However, since the T/R modules are capable of amplifying their input transmission signals by a factor of several hundred, the power loss is insignificant compared to the beam power actually radiated from the actuated sector.

The system operation in the RECEIVE mode will now be described. The combiner-dividers in the second array 76 divide input signals from the activated sector of T/R modules 54 via lines 80 during RECEIVE into N portions, where N is again the number of sets in each sector. With N=4, the signal portions from each combiner-divider in array 76 are labeled a, b, c and d. This is opposite to the signal flow that takes place during TRANSMIT, when the combiner-dividers in array 76 combine input transmission signal portions from their respective lines a,b,c,d into combined output signals for delivery to the first array 74 along lines 80.

As with the combiner-dividers in each array, M sum-and-difference processors 78 are provided, with M again equal to the total number of T/R module-antenna element sets. Each sum-and-difference processor 78 is connected to receive signal portions during RECEIVE from the combiner-dividers in array 76 (via the combiner-dividers in array 77) that corresponds to a respective sector. Since adjacent sectors overlap, the signal portions from each combiner-divider in array 76 are distributed among four different sum-and-difference processors 78, with each sum-and-difference processor in turn receiving signal portions from the four different combiner-dividers within a particular sector. This is illustrated in FIG. 5, in which the signal portions a–d from each combiner-divider in array 76 are shown as being distributed (via combiner-dividers 77) among the two sum-and-difference processors immediately to the left, and the two sum-and-difference processors immediately to the right. The signal portion going to the leftmost sum-and-difference processor is labeled a, the signal portion going to the rightmost sum-and-difference is labeled d, and the signal portions going to the intermediate sum-and-difference processors are labeled b and c in order. Thus, each sum-and-difference processor will receive the c and d signal portions from the two combiner-dividers 76 immediately to the left, and the a and b signal portions from the two combiner-dividers 76 immediately to the right. Each set of received signal portions corresponds to a particular sector, since each combiner-divider in array 76 is connected to a corresponding combiner-divider in array 74, which in turn is connected to a corresponding set of T/R modules and antenna elements. Each sum-and-difference processor 78 will thus produce Σ and Δ output signals, with the Σ symbol representing the in-phase component of its a/b and c/d inputs, and the Δ output representing the phase differential between these two sets of inputs.

Combiner-divider 82 simply sums all of the Σ signals received from sum-and-difference processor 78 during RECEIVE, and outputs a composite Σ signal on output line 86. Switch 84 is operated in synchronism with the T/R module actuation select 72 so that only the Δ output from the single sum-and-difference processor 78 that receives signals from the actuated sector is passed on to a Δ output line 88.

Figure 6:
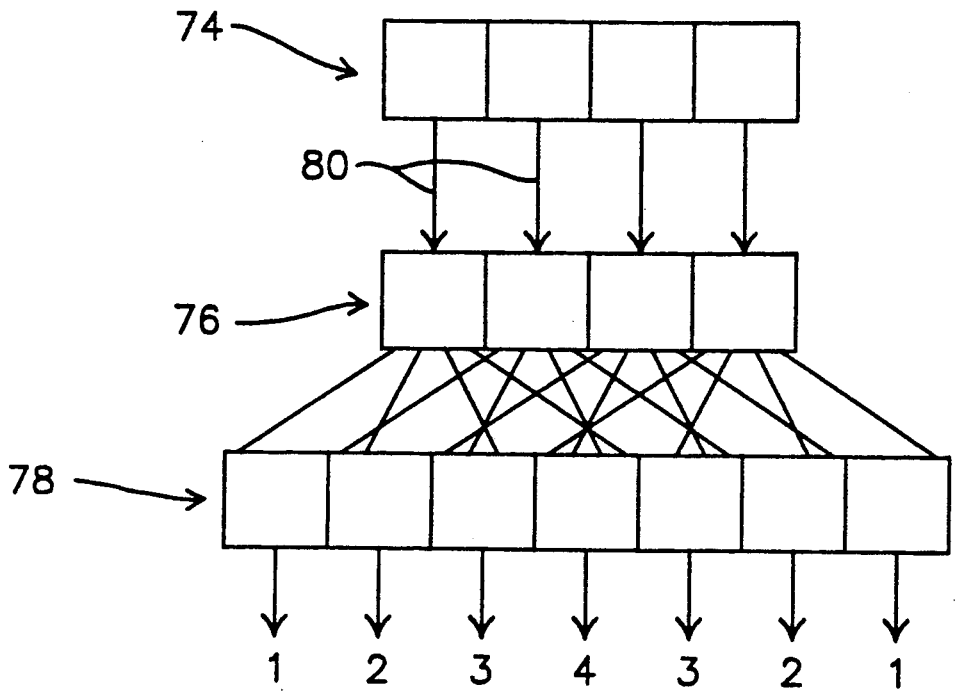
FIG. 6 is a block diagram of a portion of the signal routing network illustrating the input signal routing during RECEIVE.

The signal flows which generate the Σ outputs from sum-and-difference processors 78 during RECEIVE are illustrated in FIG. 6. (Combiner-dividers 77 are not shown in FIG. 6 for simplicity). Continuing the example of N=4 sets per sector, only four combiner-dividers within the first array 74 will receive input signals from their respective sets of T/R modules during RECEIVE, since the T/R modules for the remaining sets are gated off. Accordingly, only these four combiner-dividers need be considered. The received signals are passed on to the second array of combiner-dividers 76, which distribute them among the sum-and-difference processors 78 as described above.

A total of seven 4-way sum-and-difference processors 78 will receive signal portions from the combiner-dividers 76, with the outermost sum-and-difference processors receiving one signal portion each, the next inner pair receiving two signal portions each, the next pair receiving three signal portions each, and the innermost center sum-and-difference processor receiving four signal portions. Thus, a total of sixteen signal portions will contribute to the signal forwarded to Σ combiner-divider 82, and the composite Σ signal delivered over output Σ line 86 will likewise represent sixteen signal portions. By contrast, Δ switch 84 will select an output Δ signal only from the center sum-and-difference processor 78. That Δ signal, representing the result of only four signal portions, is delivered to the processing circuitry over output Δ line 88. Since the composite Σ signal over line 86 is a result of four times as many signal portions, it should be scaled down by a factor of four in the subsequent Δ–Σ processing circuitry to restore a scaling balance between the Δ and Σ signals.

Figure 7:
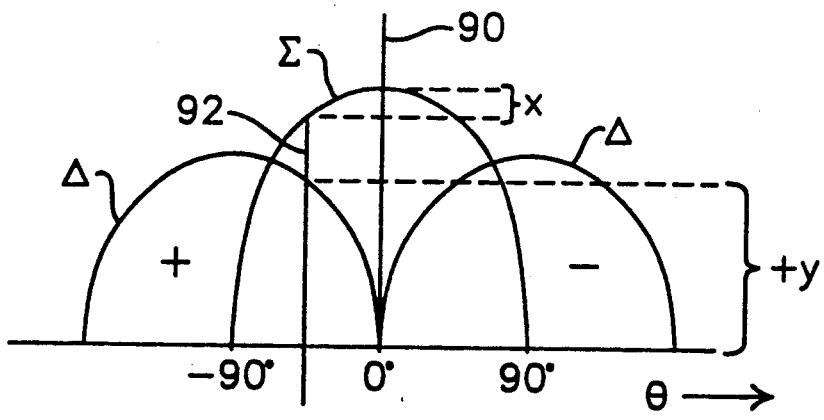
FIG. 7 is a phase diagram of the Σ and Δ antenna patterns obtained with the system of FIG. 5.

FIG. 7 is a conventional plot (not to scale) of the Σ and Δ signals as a function of azimuth angle Θ. The Σ lobe is centered upon the center axis 90 at $\theta=0°$, whereas the two 180° out-of-phase Δ lobes increase from zero at the sector axis to maximum values off-axis. The left lobe is shown as "+(90°)" phase, and the right as "−(90°)", but this is for illustrative purposes only. Azimuth error in practice is restricted to within the region between the main Σ beam and Δ beam crossovers. If the Σ beam is pointed $\Delta\theta$ to the right of the target, the angular divergence $+\Delta\theta$ 92 from the sector's axis 90 results in a Σ differential x. Since this occurs near the peak of the sinusoidal Σ lobe, x is quite small relative to the absolute Σ value. By contrast, since the $+\theta$ divergence 92 intersects the Δ lobe near its maximum, the Δ differential +y is quite large compared to the maximum Δ value. The Σ combiner-divider 82 outputs the actual Σ value $\Delta\theta$ from the sector axis, rather than the slightly higher peak Σ value, but the difference is negligibly small. On the other hand, since the Δ output is obtained only from a single sum-and-difference processor, its magnitude is equal to the true Δ value +y.

While a particular embodiment of the invention has been shown and described, numerous variations and alternate embodiments will occur to those skilled in the art. For example, while the invention has been described in terms of a system for determining azimuth error, it might also be applicable to elevation errors, although this has not yet been demonstrated, as of the execution of this application. Accordingly, it is intended that the invention be limited only in terms of the appended claims.

What is claimed as new and desired to be secured by Letters Patent of the United States is:

1. A directional transmit/receive system for electromagnetic radiation, comprising:

a plurality of active transmit/receive (T/R) modules coupled with respective electromagnetic radiation transmission and reception elements and organized into sets of at least one T/R module each, with said sets of T/R modules organized into a plurality of spatial sectors, each of said T/R modules including means to amplify an applied signal only when the module is actuated, a plurality of sum-and-difference processors corresponding to said sectors for producing sum (Σ) and difference (Δ) signals which respectively represent the in-phase and out-of-phase component of signals received by said sectors during a RECEIVE mode, and for dividing respective input signals among said sectors during a TRANSMIT mode, signal routing means connecting each of said sum-and-difference processors with a respective sector of T/R modules during RECEIVE and TRANSMIT, a fixed signal divider means for dividing an input TRANSMIT signal among said sum-and-difference processors without switching during a TRANSMIT mode, a single multi-pole switch connected to select among said sum-and-difference processors for reception of a difference signal from a selected sector during a RECEIVE mode, a fixed signal combiner means connected to combine the sum signals from said sum-and-difference processors without switching during a RECEIVE mode, and means for selectively actuating a sector of T/R modules while leaving the T/R modules outside of said sector unactuated.

2. The system of claim 1, further comprising an output switch for selecting among said sum-and-difference processors during RECEIVE, so that the correct Δ signal from only the selected sector is obtained.

3. The system of claim 2, said signal routing means comprising a plurality of signal combiner-dividers connected to divide the signals received by said sets of T/R modules during RECEIVE among respective pluralities of said sum-and-difference processors so that each sum-and-difference processor receives the signals from a respective sector of T/R modules, and to divide the signals received by each of said sum-and-difference processor during TRANSMIT among the T/R modules of respective sectors.

4. The system of claim 1, further comprising a Σ signal combiner/divider means for combining the Σ signals for each of said sum-and-difference processors into a single composite Σ signal during RECEIVE, and for dividing an input signal among each of said sum-and-difference processors during TRANSMIT.

5. The system of claim 1, said actuating means including means for shifting the selected sector among said sets of T/R modules.

6. The system of claim 5, wherein said sets of T/R modules are arranged in a closed array.

7. A directional reception system for electromagnetic radiation, comprising:

a plurality of signal receive modules coupled with respective electromagnetic radiation reception elements and organized into sets of at least one module each, with said sets of modules organized into a plurality of spatial sectors, said modules including means to amplify signals received from said reception elements when the modules are actuated, but not otherwise, a plurality of sum-and-difference processors corresponding to said sectors for producing sum (Σ) and difference (Δ) signals which respectively represent the in-phase and out-of-phase component of signals received by said sectors from said receptor elements, signal routing means connecting each of said sum-and-difference processors with a respective sector of modules, a single multi-pole switch connected to select among said sum and difference processors for reception of a difference signal from a selected sector, a fixed signal combiner means connected to combine the sum signals from said sum-and-difference processors without switching, and means for selectively actuating a sector of modules while leaving the modules outside of said sector unactuated.

8. The system of claim 7, further comprising an output switch for selecting among said sum-and-difference processors so that the correct Δ signal from only the selected sector is obtained.

9. The system of claim 8, said signal routing means comprising a plurality of signal dividers connected to divide the signals received by said sets of modules among respective pluralities of said sum-and-difference processors so that each sum-and-difference processor receives the signals from a respective sector of modules.

10. The system of claim 7, further comprising a Σ signal combiner means for combining the Σ signals from each of said sum-and-difference processors into a single composite Σ signal.

11. A directional transmission system for electromagnetic radiation, comprising:

a plurality of signal transmission modules coupled with respective electromagnetic radiation transmission elements and organized into sets of at least one module each, with said sets organized into a plurality of spatial sectors, each of said modules including means to amplify an applied signal and provide the amplified signal to its respective transmission element when the module is actuated, but not otherwise, fixed means for dividing an input signal into a plurality of signal portions without switching, with one signal portion for each set of modules, means for applying said signal portions to their respective sets of modules, and means for selectively actuating a sector of modules while leaving the modules outside of said sector unactuated.

12. The system of claim 11, including M sets of transmission elements organized into sectors of N sets each, said signal dividing means comprising a first order divider means for dividing the input signal into M first order divided signals, M second order divider means for dividing each of said first order divided signals in N second order divided signals, and M combiner means for combining respective sets of N second order divided signals from N different second order divider means into said signal portions.

13. A directional transmit/receive system for electromagnetic radiation, comprising:

a plurality of electromagnetic radiation active transmit/receive (T/R) modules organized into sets of at least one module each, with said sets of modules organized into a plurality of overlapping sectors of N sets each, where N is greater than one, each successive pair of adjacent sectors including at least one set in common, a first array of fixed signal combiner-divider means for combining input received signals from respective sets of modules into respective output signals without switching during RECEIVE, and for dividing respective input transmission signals into output signals for delivery to respective sets of T/R modules without switching during TRANSMIT, a second array of fixed signal combiner-divider means, each connected to divide the output signals from a respective combiner-divider means within said first array into N output signals without switching during RECEIVE, and to combine N respective input signals into an input signal for its respective combiner-divider means within said first array without switching during TRANSMIT, an array of sum-and-difference processors for producing phase-based sum ($\Sigma$) and difference ($\Delta$) signals from the output signals received from respective sets of N combiner-divider means within said second array during RECEIVE, said $\Sigma$ and $\Delta$ signals from the output signals received from respective sets of N combiner-divider means within said second array during RECEIVE, said $\Sigma$ and $\Delta$ signals respectively representing the in-phase and out-of-phase component of said signals, and for dividing respective input signals into N input signals each for said second array of signal combiner-divider means during TRANSMIT, a single multi-pole switch means for selecting among said sum-and-difference processors to acquire the $\Delta$ signal corresponding to a desired sector during RECEIVE, a fixed $\Sigma$ combiner-divider means for combining each of said $\Sigma$ signals during RECEIVE, and for dividing an input signal into respective input signals for each of said sum-and-difference processors during TRANSMIT, both without switching, and means for selectively actuating a sector of T/R modules while leaving the T/R modules outside of said selected sector unactuated.

14. The system of claim 13, said actuating means including means for shifting the selected sector among said sets of T/R modules.

15. The system of claim 14, wherein said sets of T/R modules are arranged in a closed array.

16. A directional reception system for electro-magnetic radiation, comprising:

an array of radiation receptor elements organized into M sets of elements, with said sets organized into sectors of N sets each, where N is greater than one, each successive pair of adjacent sectors including at least one set in common, means for amplifying input radiation signals received by each of said sets of receptor elements, means for actuating the amplifying means for the sets of a selected sector, leaving the amplifying means for the remaining sets unactuated, M sum-and-difference processors for determining phase differences between their respective inputs, M fixed signal dividers connected to receive the amplified signal from a respective set of receptor elements and to divide said signal into N output each without switching, said signal divider outputs being connected as inputs to respective sum-and-difference processors such that said sum-and-difference processors are each connected to receive inputs from respective sectors, a single multi-pole switch means for selecting among said sum-and-difference processors to obtain a signal that represents the out-of-phase component among the input signals to a selected sector, and fixed means for obtaining signals from said sum-and-difference processors without switching that represent the in-phase component among the input radiation signals received by the receptor elements within the selected sector, said signals representing said out-of-phase and in-phase components providing an azimuth indication for the radiation received by the selected sector.

17. The system of claim 16, wherein said signal obtaining means obtains and sums in-phase signals from each of said sum-and-difference processors.

18. A directional electromagnetic radiation transmission system, comprising:

an array of radiation transmission elements organized into M sets of elements, means for amplifying electric signals for application to said sets of elements, means for actuating the amplifying means for desired sectors of N sets each, leaving the amplifying means for the remaining sets unactuated, a fixed signal divider for dividing an input electrical signal into M first order signal portions without switching, an array of M fixed signal dividers for dividing said M first order signal portions into N second order signal portions each without switching, an array of M fixed signal combiners, each signal combiner connected to combine a second order signal portion from each of N respective signal dividers within said array of signal dividers without switching, and means connecting the outputs of each of said signal combiners as inputs to the amplifying means for respective sets of radiation transmission elements.

19. An electromagnetic radiation transmit/receive system, comprising:

a plurality of electromagnetic radiation transmission and reception elements, a plurality of selectively actuable signal transmit/-receive (T/R) modules connected to transmit signals to and receive signals from respective elements, said modules amplifying their transmitted and received signals when they are actuated but not when they are non-actuated, means connecting said modules to simultaneously receive signals from their respective elements, a switching circuit including a signal multi-pole switch for obtaining received signals from a selectable mult-set sector of said modules, fixed means for supplying transmit signals to each of said modules simultaneously without switching, and means for actuating said selected sector of modules while leaving the other modules non-actuated.

20. The system of claim 19, further comprising means for progressively advancing the selection of said module sectors by one set at a time.

21. An electromagnetic radiation reception system, comprising:

a plurality of electromagnetic radiation reception elements, a plurality of selectively actuable signal reception modules connected to simultaneously receive signals from respective elements, said modules amplifying their received signals only when they are actuated, means for actuating selected multi-set sectors of modules while leaving the other modules non-actuated, each set including at least one module, and means for progressively advancing the actuation of said module sectors by one set at a time.

22. An electromagnetic radiation transmission system, comprising:

a plurality of electromagnetic radiation transmission elements, a plurality of selectively actuable signal transmission modules connected to amplify applied transmission signals only when they are actuated, means for supplying transmission signals to each of said modules simultaneously, means for actuating selected multi-set sectors of modules while leaving the other modules non-actuated, each set including at least one module, and means for progressively advancing the selection of said module sectors by one set at a time.

23. A method of transmitting electromagnetic radiation, comprising:

supplying transmission signals, without switching said signals, to each of a plurality of selectively actuable active transmit/receive (T/R) modules which amplify said signals only when actuated, connecting amplified outputs from said T/R modules to respective radiation transmission elements, and actuating some but less than all of said T/R modules at a given time so that the actuated T/R modules amplify their respective transmission signals and said amplified signals are transmitted by their respective transmission elements, with the transmission signals supplied to the non-actuated T/R modules not used for signal transmission.

24. The method of claim 23, wherein said radiation transmission elements are organized into a plurality of spatial sectors with each successive pair of sectors having at least some elements in common, and the T/R modules for the elements in only one sector at a time are actuated.

25. The method of claim 24, wherein the actuation of said T/R modules is progressively shifted among said sectors.

26. A method of receiving electromagnetic radiation, comprising:

receiving said radiation with a plurality of radiation receptor elements, supplying received signals from said receptor elements to respective selectively actuable active transmit/receive (T/R) modules which amplify said signals only when actuated, routing received signals from selected T/R modules to receive circuitry with a single multi-pole switch, and processing received signals amplified by said selected T/R modules in said receive circuitry.

27. The method of claim 26, wherein said radiation reception elements are organized into a plurality of spatial sectors, with each successive pair of sectors having at least some elements in common, and the T/R modules for the elements in only one sector at a time are actuated.

28. The method of claim 27, wherein the actuation of said T/R modules is progressively shifted among said sectors.

29. The system of claim 1, said fixed signal divider means for TRANSMIT and said fixed signal combiner means for RECEIVE comprising a unitary signal combiner-divider means.

30. The method of claim 26, further comprising the step of actuating only said selected T/R modules.

* * * * *